United States Patent [19]

Dreizler

[11] Patent Number: 4,903,615

[45] Date of Patent: Feb. 27, 1990

[54] ATMOSPHERIC GAS HEATING UNIT WITH EXTERNAL RECYCLING OF EXHAUST GAS TO REDUCE $NO_x$

[76] Inventor: Walter Dreizler, Brachetweg 16, D-7000 Stuttgart 75, Fed. Rep. of Germany

[21] Appl. No.: 39,073

[22] Filed: Apr. 16, 1987

[51] Int. Cl.[4] ..... F23G 5/02

[52] U.S. Cl. ..... 110/204; 110/205; 110/206; 237/55

[58] Field of Search ..... 110/204, 205, 206, 207; 237/55

[56] References Cited

U.S. PATENT DOCUMENTS

| | | | |
|---|---|---|---|
| 1,159,028 | 11/1915 | Hocker | 110/206 |
| 1,243,943 | 10/1917 | Johns | 110/206 |
| 1,284,053 | 11/1918 | Briggs | 110/206 |
| 1,310,173 | 7/1919 | Callery | 110/206 |
| 1,837,713 | 12/1931 | Jacobus | 110/207 |
| 2,711,683 | 6/1955 | Ryder | 237/55 |
| 2,837,066 | 6/1958 | Blaskowski | 110/205 |
| 4,098,200 | 7/1978 | Dauvergne | 110/204 |
| 4,182,274 | 1/1980 | Williams | 110/204 |
| 4,242,972 | 1/1981 | Sicard | 110/206 |
| 4,355,601 | 10/1982 | Hattiangadi | 110/205 |

FOREIGN PATENT DOCUMENTS

| | | | |
|---|---|---|---|
| 627967 | 3/1936 | Fed. Rep. of Germany | 110/206 |
| 208321 | 4/1940 | Switzerland | 110/206 |

*Primary Examiner*—Henry C. Yuen
*Attorney, Agent, or Firm*—Edwin E. Greigg

[57] ABSTRACT

An improved burner head for a forced air furnace is disclosed which includes a burner tube fitted with gas nozzles, air flow openings, and a flame tube. At least one radial opening is provided between the end of the burner tube and an end of the flame to allow exhaust gas recirculation via a ribbed ring secured between the burner tube and the flame tube upstream of the radial opening but downstream of the gas nozzles and airflow openings. The ribbed ring includes ribs protruding radially inward crosswise to the longitudinal axis of the burner head. The burner head allows for a substantial reduction in NOx, to a level on the order of less than 50 ppm.

2 Claims, 3 Drawing Sheets

Figure 1:
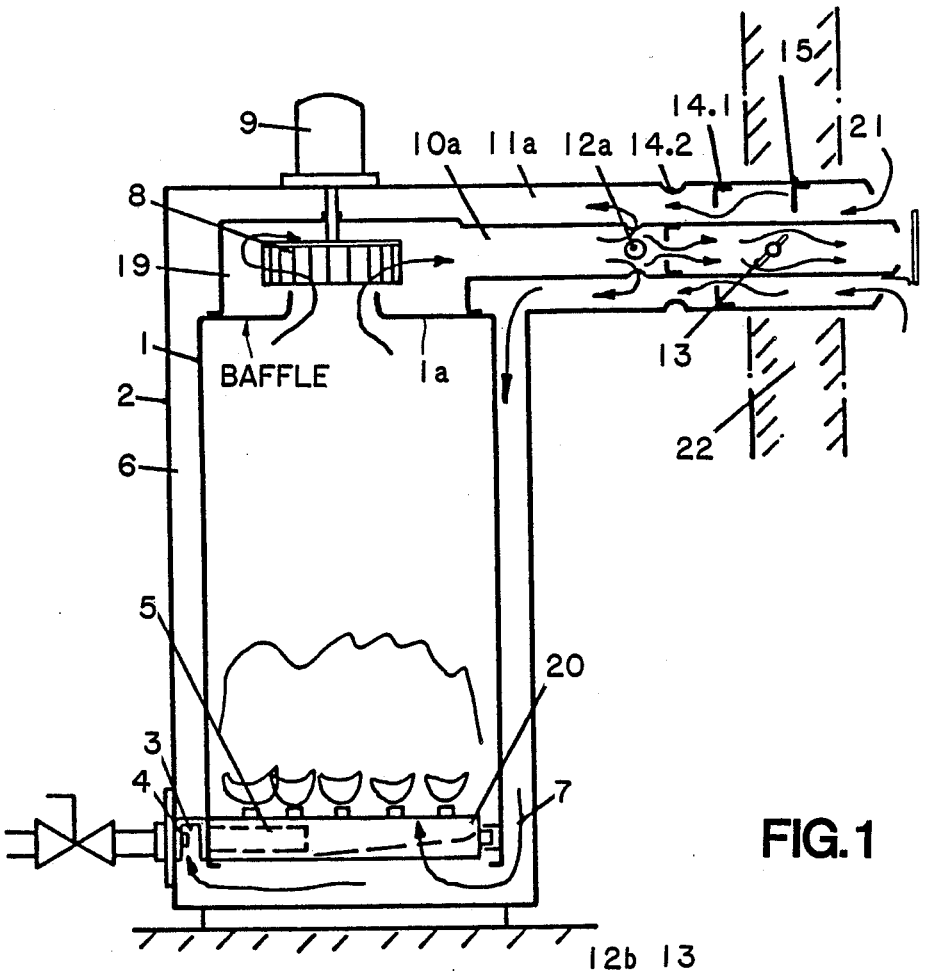

ATMOSPHERIC GAS HEATING UNIT WITH EXTERNAL RECYCLING OF EXHAUST GAS TO REDUCE $NO_x$

The invention serves to reduce $NO_x$ gas heating units which are equipped with atmospheric gas burners and have a central, that is to say joint, combustion air supply and exhaust gas removal system.

The subject of the invention is a new type of exhaust gas recycling system which allows, without an additional conveying device, part of the exhaust gas to be recycled to the atmospheric gas burner and thereby accomplishes, in a previously unknown economic way, a sufficient reduction of $NO_x$ in the exhaust gas.

Atmospheric gas burners, so-called "external face units," are known in which the combustion air conduit and exhaust gas conduit are connected to the outside atmosphere by going through the outside wall. Their conduits and combustion chamber are hermetically sealed from the area to be heated. Because of the buoyancy of the exhaust gas in the combustion chamber, this gas is only propelled toward the system which is open to the outside atmosphere. To allow the use of extended combustion air and exhaust gas pipes which lead to the outside and, as the case may be, above the roof, such atmospheric gas heating units are also equipped with a blower which is located either within the combustion air flow or within the exhaust gas flow.

On the other hand, large systems are also known which are equipped with external exhaust gas recycling devices to reduce $No_x$ wherein up to 25 percent is conveyed from the exhaust duct behind the heating unit back into the port-end of the furnace blower by a special blower unit built directly into the exhaust recycling duct.

For reasons of economy, such designs are unsuitable for heating units below 10 MW because of the additional expense of installing, operating and maintaining such units. The higher noise level generated by the additional blower has so far also been judged to be a disadvantage for units used to heat houses.

The solution offered by the subject of the invention permits the recycling—which occurs outside the combustion area—of some of the exhaust gas from the exhaust duct directly into the adjoining air duct which is positioned either next to it or centrally around the outside. Using a very simple method that requires no significant additional effort, part of the exhaust gas in the exhaust duct is transferred, through one or more defined openings by fixed or adjustable differences in pressure, into the air duct through which it is directly returned to the atmospheric gas burner and its combustion chamber where the reduction of $NO_x$ takes place. The quantity of exhaust gas that thereby reaches both the primary premixed air and the secondary air region of the atmospheric gas burner is in the same ratio as that of the combustion mixture.

The present invention will be explained on the basis of examples of applications. These examples differ primarily in that the blower, which simultaneously moves the exhaust gas and takes in air, is located in one case in the air duct and in the other in the exhaust conduit; otherwise, the differential pressure is, e.g., created by the same throttling devices in the air duct and/or the exhaust conduit at the indicated points in such a way that the required amount of exhaust gas becomes available for recycling.

FIGS. 1 to 4 represent examples of designs of atmospheric gas heating units with joint combustion air and exhaust gas conduits, which can be produced either as wall units or as floor units.

All the described gas heating units have, at their lower, open end of heating element 1 an atmospheric gas burner 20 which is either rod-shaped or circular. Primary air supply 3, with gas nozzle 4 and mixing pipe 5, is located in the air intake area, which can be designed either as an air channel to heating element 1 or as a circular channel 6 by encasing heating element 1; in any case, a uniform air distribution is assured in the atmospheric burner area both in primary air area 3 as well as in secondary air area 7.

Figure 2A:
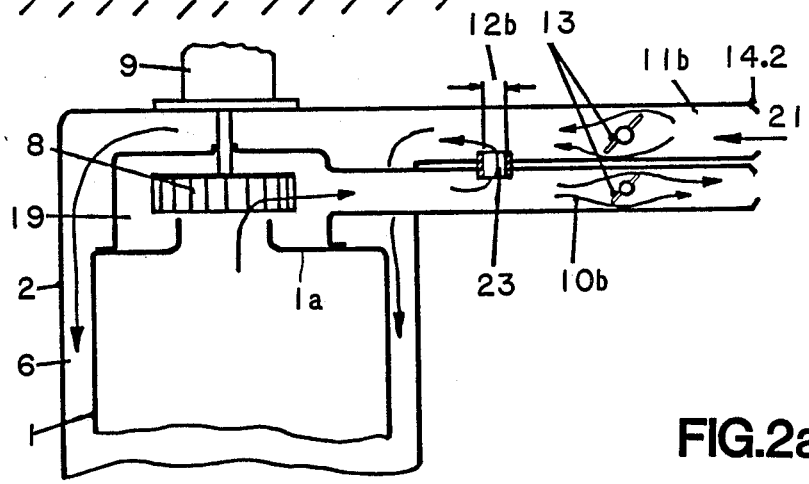

In the design illustrated in FIG. 1 and 2*a*, exhaust gas, is collected in exhaust chamber 19 by shrouded blower fan 8 with motor 9 and expelled to the outside via exhaust pipe 10*a*.

Air conduit 11*a* in FIG. 1 is centrally positioned with regard to exhaust pipe 10*a* for advancing combustion air 21.

The length of exhaust pipe 10*a* and air pipe 11*a* depends on local conditions but, in practice, it also leads along outside wall 22 to a point high above the roof, particularly in the case of modern calorific-value heating units.

Exhaust pipe 10*b* in FIG. 2*a* leads alongside air pipe 11*b* which means that both pipes are positioned next to each other.

In FIG. 1, in accordance with the invention, at some point of the described dual "exhaust pipe" - "air pipe" system, one or several excess flow openings 12*a* are positioned in such a way that differential pressure develops in throttle valve 13, which is positioned downstream in the direction of outside air within exhaust pipe 10*a* and/or air pipe 11*a*, whereby said differential pressure causes the transfer of some exhaust gas from the exhaust pipe into the air pipe; whereby the volume of the exhaust gas thus transferred is, on the one hand, a function of the differential pressure, i.e. the adjustment of the throttling device, and, on the other hand, a function of the number and size of the excess-flow openings. The throttling device can comprise diaphragm rings 14.1 or crimp-shaped pipe constrictions 14.2, partial diaphragms 15 or permanently set throttle valves 13. Excess-flow opening 12*b*, shown in FIG. 2*a*, can also comprise a connecting pipe 23 if exhaust pipe 10*b* and air pipe 11*b* are somewhat apart where they lead to the outside. Adjacent to the top of the furnace and disposed interiorly thereof is a baffle 1*a*.

Figure 3:
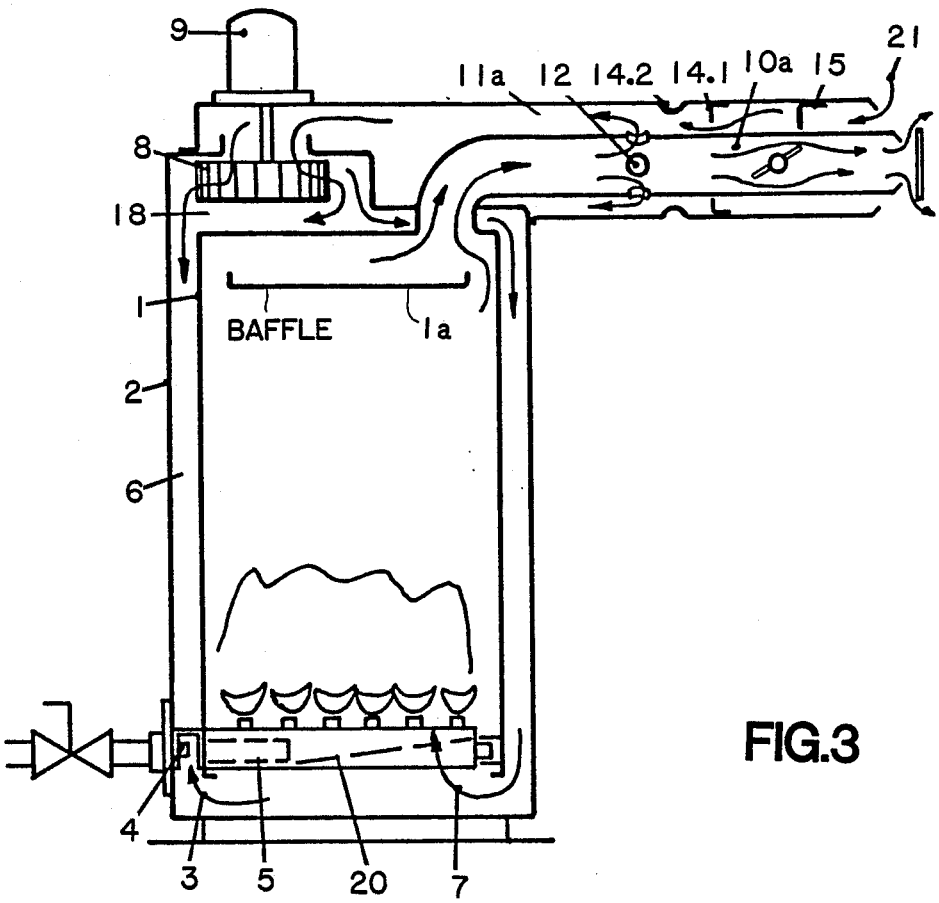
Figure 4:
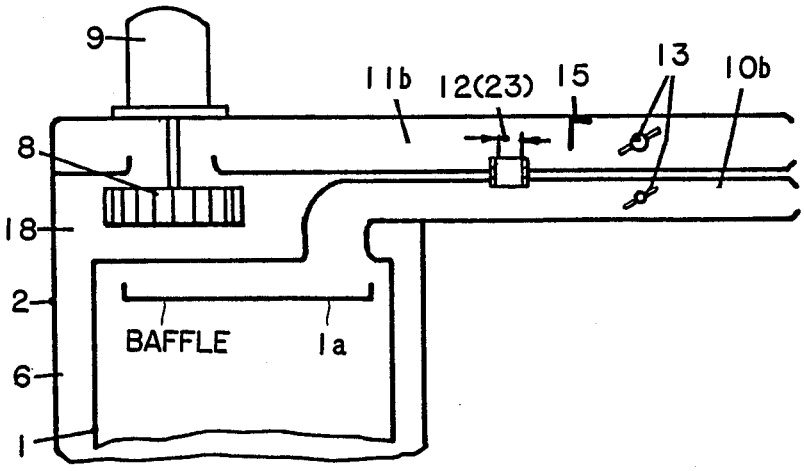

FIGS. 3 and 4 show a lateral and longitudinal view of the same gas heating unit with a blower positioned within combustion air conduit 21, wherein blower fan 8 sits within air intake chamber 18 and is driven by motor 9. Combustion air 21 is taken in via air pipe 11*a* from the outside. Exhaust gas is removed via exhaust pipe 10*a*.

Exhaust pipe 10*a* in FIG. 3 is positioned centrally with regard to encircling stack air pipe 11*a*. Also in FIG. 4 exhaust pipe 10*b* and stack air pipe 11*b* are positioned alongside one another.

Figure 2B:
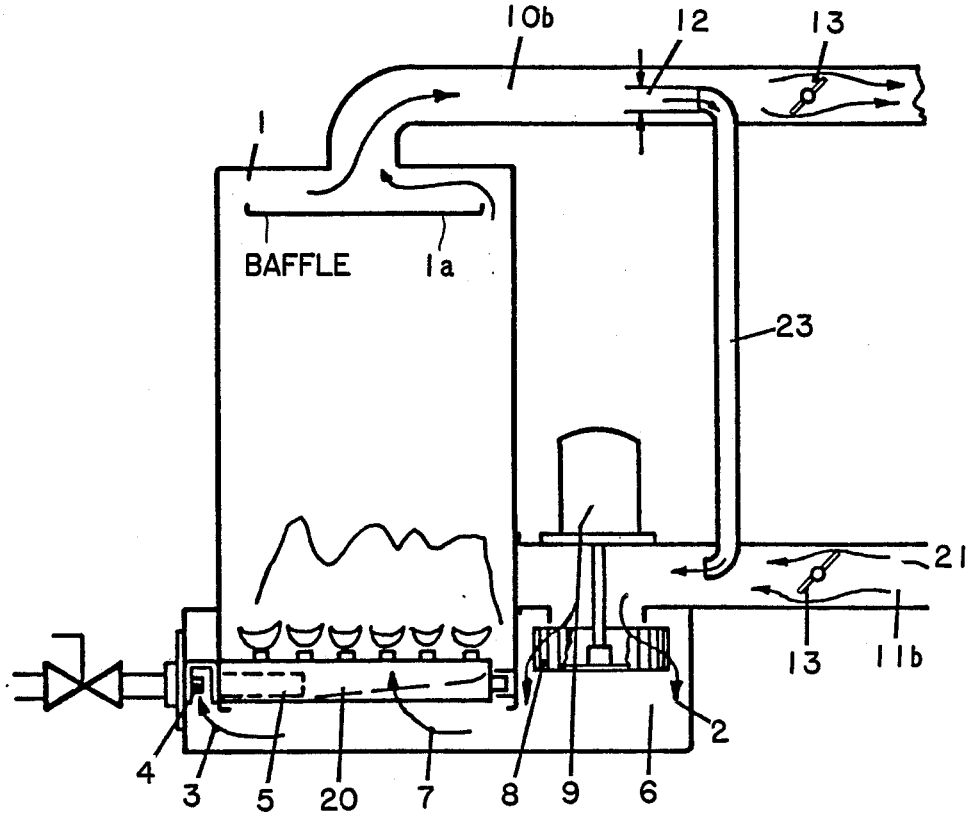

Values 13 and 14 of the invention, which assure the transfer of some of the exhaust gas from the exhaust pipe into the air pipe, are exactly the same as those already described in FIGS. 1 and 2. The description thereof in FIGS. 1 and 2*a* is also valid for FIGS. 3 and 4. As has already been noted initially, recycling of exhaust gas also works with arrangements 12, 13, 14, 15 and 23 of the invention for atmospheric gas heating units without a blower if a sufficiently large heating element 1 produces excess pressure as a result of buoyancy.

As can be seen from the described examples of the invention's applications of atmospheric gas heating units connecting to an external wall, external recycling of gas is effected through a very simple construction and inexpensive procedure which allows a significant reduction of $NO_x$ to less than 57 ppm which, when applied to small gas heating units, can be considered to be practically free of harmful substances which no longer cause environmental damage.

I claim:

1. A furnace construction provided with a firebox and a gas burner unit in said firebox, said furnace further including a perforate upper portion, a baffle upstream of said perforate upper portion of said furnace, said baffle adapted to control discharge of at least a portion of gases from said furnace to a stack air pipe downstream of said furnace, a single blower means disposed within said furnace downstream of said baffle, said stack air pipe encompasses an exhaust pipe (10*a*), a throttle valve means in said exhaust pipe downstream of said single blower means, and at least one flow control opening (12, 12*a*) in said exhaust pipe upstream of said throttle valve means adapted to return exiting products of combustion to said single blower means, and said stack air pipe and said exhaust pipe encompassed thereby are provided with diaphragm rings which control flow therethrough.

2. A furnace as claimed in claim 1, in which said stack air pipe and said exhaust pipe are disposed in coplanar relation.

* * * * *

UNITED STATES PATENT AND TRADEMARK OFFICE

CERTIFICATE OF CORRECTION

PATENT NO. : 4,903,615

DATED : February 27, 1990

INVENTOR(S) : WALTER DREIZLER et al

It is certified that error appears in the above-identified patent and that said Letters Patent is hereby corrected as shown below:

On the title page, add the following [76] Ulrich Dreizler, Verenaweg 3, 7208 Spaichingen; both of Fed. Rep. of Germany

Signed and Sealed this

Thirteenth Day of August, 1991

*Attest:*

*Attesting Officer*

HARRY F. MANBECK, JR.

*Commissioner of Patents and Trademarks*